US006250391B1

(12) United States Patent
Proudfoot

(10) Patent No.: US 6,250,391 B1
(45) Date of Patent: Jun. 26, 2001

(54) PRODUCING HYDROCARBONS FROM WELL WITH UNDERGROUND RESERVOIR

(76) Inventor: Glenn C. Proudfoot, 503-504 26th Avenue S.W., Clagary, Alberta (CA), T2S 0L9

( * ) Notice: Subject to any disclaimer, the term of this patent is extended or adjusted under 35 U.S.C. 154(b) by 0 days.

(21) Appl. No.: 09/239,766

(22) Filed: Jan. 29, 1999

(51) Int. Cl.[7] ..... E21B 43/38
(52) U.S. Cl. ..... 166/369; 166/244.1; 166/265
(58) Field of Search ..... 166/247, 299, 166/250.1, 252.2, 265, 369, 244.1, 243, 50; 175/67, 7, 263

(56) References Cited

U.S. PATENT DOCUMENTS

| | | | | |
|---|---|---|---|---|
| 50,903 | | 11/1865 | Casamajor | 299/2 |
| 1,506,920 | | 9/1924 | De Chambrier | 299/2 |
| 1,520,737 | * | 12/1924 | Right | 166/265 |
| 3,233,668 | * | 2/1966 | Hamilton et al. | 166/259 |
| 3,233,670 | * | 2/1966 | Thompson et al. | 166/247 |
| 3,386,508 | * | 6/1968 | Bielstein et al. | 166/272 |
| 3,455,392 | * | 7/1969 | Parts | 166/303 |
| 3,478,825 | * | 11/1969 | Closmann | 166/299 |
| 3,593,789 | * | 7/1971 | Prats | 166/259 |
| 3,948,323 | * | 4/1976 | Sperry et al. | 166/303 |
| 4,037,663 | * | 7/1977 | Buchman | 166/314 |
| 4,078,609 | * | 3/1978 | Pavlich | 166/271 |
| 4,099,570 | | 7/1978 | Vandergrift | 166/303 |
| 4,160,481 | | 7/1979 | Turk | 166/272 |
| 4,618,029 | * | 10/1986 | Carter et al. | 175/267 |
| 4,887,670 | * | 12/1989 | Lord et al. | 166/281 |
| 4,934,458 | * | 6/1990 | Warburton et al. | 166/370 |
| 4,949,749 | * | 8/1990 | Fowier et al. | 137/236.1 |
| 5,016,710 | | 5/1991 | Renard | 166/245 |
| 5,036,918 | * | 8/1991 | Jennings et al. | 166/263 |
| 5,044,436 | * | 9/1991 | Magnani | 166/247 |
| 5,141,057 | * | 8/1992 | Chaix | 166/373 |
| 5,265,674 | * | 11/1993 | Fredrickson et al. | 166/246 |
| 5,494,121 | * | 2/1996 | Nackerud | 175/263 |
| 5,511,905 | * | 4/1996 | Bishop et al. | 405/59 |
| 5,628,364 | * | 5/1997 | Trenz | 166/53 |
| 5,697,448 | * | 12/1997 | Johnson | 166/369 |
| 5,762,149 | * | 6/1998 | Donovan et al. | 175/40 |
| 5,875,843 | * | 3/1999 | Hill | 166/250 |
| 5,926,437 | * | 7/1999 | Ortiz | 367/35 |
| 6,070,677 | * | 6/2000 | Johnston | 175/57 |

* cited by examiner

*Primary Examiner*—David Bagnell
*Assistant Examiner*—John Kreck
(74) *Attorney, Agent, or Firm*—Merek & Voorhees

(57) ABSTRACT

A method of extracting liquid hydrocarbons from geological formations having a reduced or low liquid hydrocarbon flow rate utilizing a wellbore extending downwardly from the surface of the ground into the geological zone of interest. The method includes the steps of first creating at least one downhole reservoir through enlarging a portion of the wellbore. The downhole reservoir is made substantially larger than the wellbore and formed so as to hold a desired amount of effluent, which includes liquid hydrocarbons, based upon approximated flow rates of effluent from the geological zone of interest. Effluent is allowed to accumulate in the downhole reservoir for a desired length of time until it reaches a desired level. Finally, the effluent is evacuated from the downhole reservoir through the use of a pump.

14 Claims, 4 Drawing Sheets

PRODUCING HYDROCARBONS FROM WELL WITH UNDERGROUND RESERVOIR

FIELD OF THE INVENTION

This invention relates to a method of extracting hydrocarbons from underground geological formations, and in particular, a method particularly suited to the extraction of liquid hydrocarbons in geological formations having generally reduced or low liquid hydrocarbon flow rates.

BACKGROUND OF THE INVENTION

Typically, liquid hydrocarbons (commonly referred to a crude oil) are extracted from natural underground hydrocarbon bearing geological formations through the drilling of a relatively small, and more or less constant, diameter wellbore (most often from approximately four inches to eight inches in diameter) from the surface of the ground downwardly through the geological formation that harbours the hydrocarbons. Most commonly, a down-hole pump is then inserted into the wellbore in order to pump the effluent produced from the geological zone of interest, including liquid hydrocarbons or crude oil, to the surface. Typically, such pumps are driven through use of sucker rods that extend from the downhole pump upwardly to the surface and are operated in a reciprocating manner by an electric or gas motor connected to the sucker rod by a series of gears and linkages. The above ground structure that is responsible for reciprocating the sucker rod is often referred to as a pump jack. In addition to the downhole pump, sucker rod and pump jack, traditional oil wells also contain a steel casing which is cemented in place and a production tubing running from the downhole pump to the surface through which the oil is pumped. The production tubing is usually secured to the bottom portion of the cased wellbore by a centralizing anchoring device and is usually subjected to wear and tear caused by the reciprocating sucker rod and through the transportation of effluent that typically has corrosive and scaling characteristics which foul and/or impair the pumping efficiency.

It will be appreciated that due to the nature of the pumping and production equipment required for a typical oil well, the equipment necessary to operate a single well represents a significant capital investment and significant ongoing operating expenses to maintain and operate such equipment continually. For wells that produce high volumes of crude oil, the capital and operating costs of the required equipment is usually more than offset by the revenue generated from the crude oil that is produced. However, low producing or low volume oil wells may, in many cases, not produce sufficient volumes of oil to offer sufficient cash flows during low crude oil price levels to justify the exploitation of the geological zone of interest and/or the on-going operation of such marginal oil wells.

There is therefore the need for a method of extracting liquid hydrocarbons from underground hydrocarbon bearing formations having reduced or low hydrocarbon flow rates which requires a less significant capital outlay and that has lower operating costs. Similarly, there is a need for a method that may be used to extract hydrocarbons from underground geological formations where traditional oil extraction methods have been utilized but, due to reduced hydrocarbon flow rates, are no longer financially practical to develop and exploit.

SUMMARY OF THE INVENTION

The invention therefore provides a method of extracting hydrocarbons from underground geological formations that addresses the limitations of the prior art through the utilization of a procedure that minimizes capital costs in terms of production equipment required, and that helps to minimize the ongoing operating and maintenance costs required to extract the hydrocarbons.

Accordingly, in one of its aspects the invention provides a method of extracting liquid hydrocarbons from geological formations having a reduced or low liquid hydrocarbon flow rates wherein conventional extraction methods that utilize a wellbore extending downwardly from the surface of the ground into the geological zone of interest that harbours liquid hydrocarbons have been previously employed, the method comprising the steps of creating at least one downhole reservoir through enlarging a portion of the existing wellbore, the downhole reservoir substantially larger than the existing wellbore and formed so as to hold a desired amount of effluent based upon approximated flow rates of effluent from the geological zone of interest, the effluent including liquid hydrocarbons; allowing effluent to accumulate in the downhole reservoir for a desired length of time until effluent in the reservoir reaches a desired level; and, thereafter evacuating accumulated effluent from the downhole reservoir through the use of a pump.

In a further aspect, the invention provides a method of extracting hydrocarbons from underground geological formations comprising the steps of forming a wellbore from the surface of the ground into the earth such that the wellbore intersects the geological zone of interest that harbours liquid hydrocarbons; calculating the approximate flow rate of effluent from the geological zone of interest, the effluent including liquid hydrocarbons; creating at least one downhole reservoir through enlarging a portion of the wellbore, the downhole reservoir substantially larger than the wellbore and formed so as to hold a desired amount of effluent from the geological zone of interest based upon said approximated flow rate; allowing effluent to accumulate in the downhole reservoir for a desired length of time until effluent in the downhole reservoir reaches a desired level; and, thereafter evacuating accumulated effluent from the downhole reservoir through the use of a pump.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
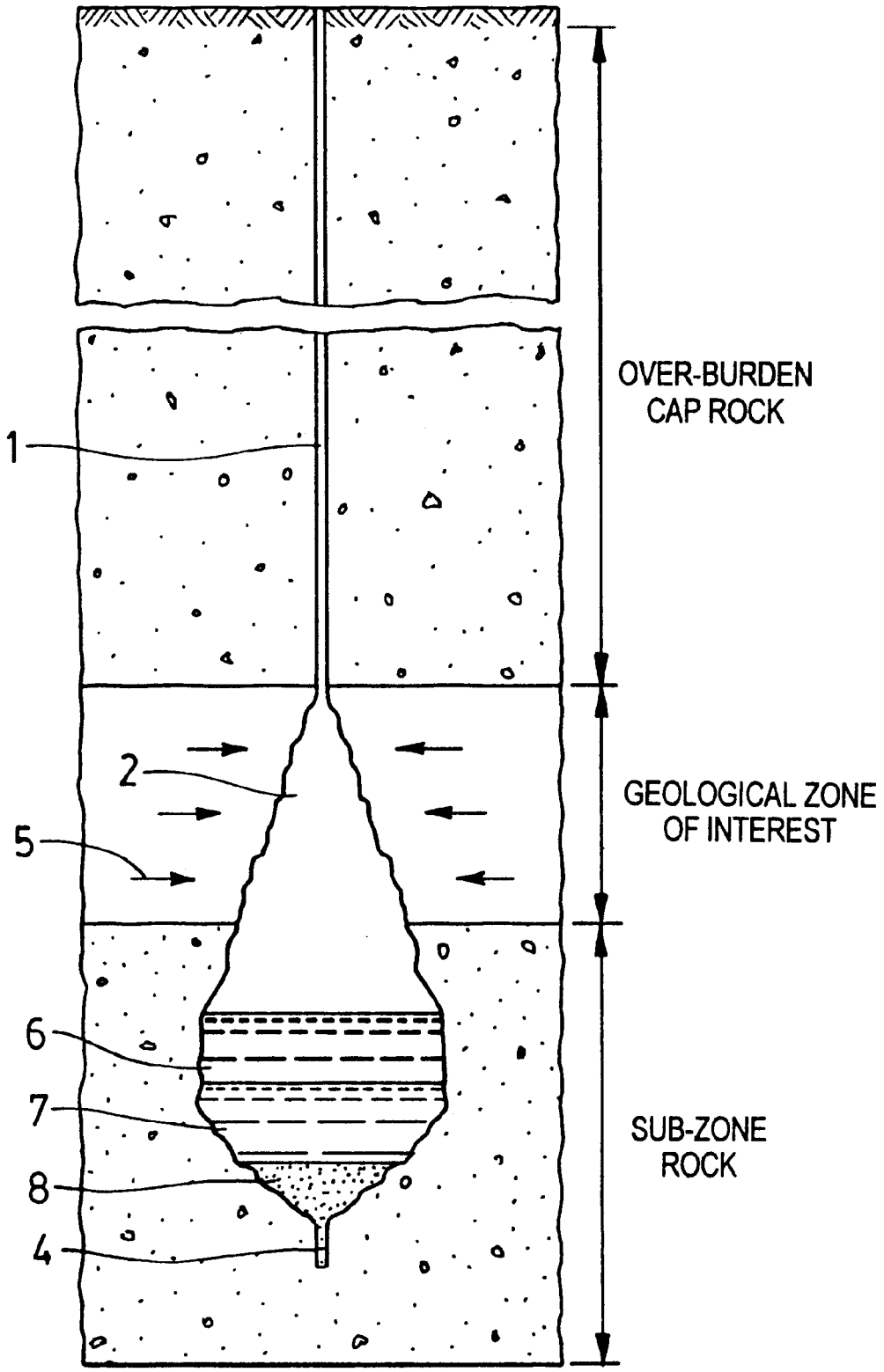
FIG. 1 is a side sectional view through a natural hydrocarbon bearing formation to which the method of the present invention has been applied.

The present invention may be embodied in a number of different forms. However, the specification and drawings that follow describe and disclose only some of the specific forms of the invention and are not intended to limit the scope of the invention as defined in the claims that follow herein.

While the present inventive method encompasses a number of different embodiments, each embodiment begins with the step of either forming a wellbore from the surface of the ground into the earth such that the wellbore intersects the geological formation of interest that harbours liquid hydrocarbons or, alternatively, begins with the utilization of the wellbore of an existing well. Where no prior wellbore exists, one may be drilled through the utilization of any of a variety of commonly used and well known drilling methods. Otherwise, where the wellbore of an existing well is to be utilized the existing production tubing and pumping structures, to the extent that such is in place, are removed and may be used elsewhere, sold for other well applications, or sold as scrap in order to recover a portion of their initial capital cost.

In either of the above scenarios (that is, following formation of the wellbore or after the appropriation of a wellbore of an existing well), the flow rate of liquid hydrocarbons from the geological zone of interest is approximated. After the approximate liquid hydrocarbon flow rate has been determined, at least one downhole reservoir is formed through enlarging a portion of the wellbore. The downhole reservoir is formed such that it is substantially larger than the wellbore and of a sufficient size so as to hold a desired amount of liquid hydrocarbons based upon the approximated flow rate. Thereafter the liquid hydrocarbons may be allowed to accumulate in the downhole reservoir for a desired length of time until they reach a desired level within the reservoir. At that point the liquid hydrocarbons may be evacuated from the downhole reservoir through the use of an intermittent pump.

It will be appreciated from a thorough understanding of the present inventive method that the method is not limited to a particular hydrocarbon flow rate, however, in most instances it is expected that the method will be applied to wellbores and geological formations having a relatively low flow rate of, for example, less than 10 barrels per day. It will also be appreciated that, particularly for low producing wells, the attractiveness of the present method is the necessity to activate a pump to evacuate liquid hydrocarbons from a well on only a periodic and intermittent basis. For example, if a particular wellbore has been determined to have a flow rate of approximately one barrel per day, the downhole reservoir could be formed such that it is capable of holding at least 30 barrels of oil, thereby removing the need to activate a pump to extract the oil from the reservoir more often than every 30 days. The capital and operating cost advantages of being able to utilize an intermittent artificial lifting mechanism to extract the effluent, including accumulated liquid hydrocarbons, from the downhole reservoir will be clearly appreciated by those skilled in the art. The need and cost associated with the constant operation of a downhole reciprocating or positive displacement pump is removed. Furthermore, the high capital cost of such equipment is also eliminated.

Extraction of the liquid hydrocarbons from the downhole reservoir may be accomplished through the use of a submersible pump lowered into the wellbore, or through the insertion of a suction line, attached to an above ground pump, downwardly through the wellbore and into the downhole reservoir. The submersible pump, or the above ground pump and suction line, may be carried on a truck or trailer that enables oil to be extracted from a well and pumped directly into a portable storage facility or tank or a pipeline gathering system. A downhole reservoir of sufficient size allows for this pumping procedure to be preformed on a regular, intermittent basis. For example, under the above scenario, once every 30 days. It will therefore be appreciated that a single mobile pumping unit could be utilized for servicing a number of such oil wells, thereby significantly reducing the overall capital cost by eliminating the need to have a designated pump for each well. In addition, the operating costs of running and maintaining such wells can be substantially reduced as operations would be intermittent and the submersible equipment routinely retrieved to conduct repairs and maintenance. There will also be a mitigation of the loss of revenue caused by typical pumping equipment failures that require service-rig workovers to repair. Where the method is applied to existing wells, there is also the realization of a return of a portion of the costs as the existing pumping equipment and tubulars are salvaged can be sold as used equipment or for scrap.

In creating the downhole reservoir, the wellbore would typically be entered with specially designed downhole tools enabling an operator to mill out an enlarged reservoir at and/or below the hydrocarbon zone of interest. The milled debris would typically be of a size smaller than the diameter of the wellbore such that it can then be removed by one of any number of conventional methods utilized in underground drilling and boring procedures. Alternatively, rather than using boring or milling operations the underground reservoir could be formed by other destructive methods such as through the use of high pressure water jet excavation, micro-wave vibration, laser, or through underground blasting. Some applications where the rock structure surrounding the excavated downhole reservoir is porous, permeable, fractured or of minimal strength, the reservoir may have to be treated and/or lined with a substance serving to support and add additional strength to the sides and exposed surfaces of the reservoir to prevent sloughing, caving, crumbling, the invasion of non-commercial effluents into the downhole reservoir, or the escape of accumulated hydrocarbons from the downhole reservoir. It is expected that the most common form of lining material would be a synthetic or cementatious compound. In addition, typical effluent from geological zones of interest contain certain natural elements and compounds that are particularly conducive to sealing or forming a natural wax sealant which, over time, will tend to seal the downhole reservoir It is expected that in most applications at least a portion of the downhole reservoir will be formed within the geological zone of interest, that harbours liquid hydrocarbons. However, in other cases the downhole reservoir may be created such that it is completely within the geological zone of interest, or such that it is completely below the geological zone of interest. The choice of the precise location of the downhole reservoir will, to a very large extent, be a function of the flow rate of the hydrocarbons, the depth of the geological zone of interest, the ease by which one can destruct the rock to form a downhole reservoir, its other inherent geological characteristics, and the way in which the wellbore was completed prior to making the downhole reservoir. To the extent that a portion, or the entirety, of the downhole reservoir is within the geological zone of interest the interface between the hydrocarbon zone and the typical wellbore will be enlarged, considerably increasing the ability of the hydrocarbon zone to yield its effluent. In many existing wells, the drainage or production performance of liquid hydrocarbons from the geological zone of interest is restricted or choked back by the constant, small diameter dimension of a typical wellbore. Accordingly, the method of the present invention in some cases presents the opportunity to create an enlarged interface with the hydrocarbon bearing zone which will enhance the liquid hydrocarbon flow rate.

To the extent that the downhole reservoir is located at least partially or completely below the hydrocarbon bearing zone, the method of the present invention will further help to increase or enhance the physical flow dynamics of the effluent by effectively reducing the hydrostatic head that would otherwise be present in the wellbore. In a typical oil well, a rising hydrostatic head is caused by the effluent from the hydrocarbon zone flowing into the wellbore and accumulating therein. As the level of effluent rises within the wellbore, the hydrostatic pressure of the effluent has the effect of slowing down the flow of effluent from the geological zone of interest. In some cases, the hydrostatic pressure may reach a point where the column of effluent in the wellbore is equal to the pressure of the effluent at the interface between the wellbore and the hydrocarbon zone, effectively halting the flow of effluent therefrom. This negative effect of the hydrostatic head is typically offset in the prior art by the introduction of an artificial lifting device, such as the typical downhole pump. However, the creation of a downhole reservoir substantially avoids these negative effects by providing a larger reservoir within which effluent can accumulate without being impeded by the formation of a hydrostatic head. As indicated previously, the reservoir can be formed such that its size is of a sufficient volume to make it commercially viable to provide an intermittent artificial lifting means to evacuate accumulated effluent.

The present invention further provides the step of utilizing the downhole reservoir as a below ground settling and separation tank to help assist in the physical separation of liquid hydrocarbons from water and particulate debris. That is, as effluent from the geologic zone of interest accumulates in the downhole reservoir, the difference in the specific gravity of its various components will result in a separation or stratification of those components. The downhole reservoir thereby effectively operates as a settling or separation tank enabling the lighter hydrocarbons to float on top of any water that may be produced in association with the liquid hydrocarbons. The reservoir also allows solid sediments to settle out of both the hydrocarbons and water. The operator of a submersible pump or suction line lowered into the downhole reservoir is then able to place the pump or suction line at a particular position within the reservoir so as to remove only the hydrocarbons or, alternatively, to remove water that has accumulated toward the bottom of the reservoir. Alternatively, the operator is provided with a crude ability to progressively evacuate the accumulated effluent into its basic components as the effluent is drawn down. In traditional oil wells such separation is not possible and must be accomplished through the use of separate above ground separation tanks. In some instances it is expected that the formation of downhole reservoirs under the present invention will completely remove the necessity of above ground separation tanks while in other instances utilization of the present invention will substantially reduce the extent of above ground separation required.

The inventive method also provides the further advantage of presenting an underground storage facility to hold accumulated hydrocarbons. In a typical oil well, oil is constantly being pumped to the surface and must be stored in tanks or other storage facilities, or must be transported by pipeline to storage facilities. Such storage facilities carry with them an associated capital and operating costs, and also represent potential environmental hazards and problems due to fire, vandalism, theft and acts of God. Accumulating the effluent from the geological zone of interest in a downhole reservoir, until such time as it can be evacuated and transported by truck or pipeline directly to a processing facility, will eliminate or substantially minimize the risks, liability, and costs associated with the storage of produced effluent in above ground tanks. Furthermore, when liquid hydrocarbons are brought to the surface and moved from their downhole pressure and temperature regime to standard atmospheric temperatures and pressures, their physical properties can be altered and the volatile hydrocarbons are released and lost to the atmosphere unless contained by artificial means. However, the present invention permits the hydrocarbons to be stored at or near the pressures and temperatures within which they naturally occur in the hydrocarbon bearing zone, thereby minimizing the loss of the more volatile hydrocarbons and mitigating the adverse environmental consequences of typical production methods. Through evacuating the hydrocarbons retained within the downhole reservoir on mass and transferring them directly into a pipeline, storage tank or facility, the loss of volatiles can be minimized. Where the volume of volatiles is significant, they can then be commercially captured for processing.

In an alternate embodiment of the present invention, floats or sensors may be inserted into the downhole reservoir to provide an indication of the level of hydrocarbon effluent within the reservoir. Either submersible or above ground pumps can then be activated by means of automatic controls when the level of liquid hydrocarbons within the reservoir reaches a pre-determined point. The floats or sensors serving the downhole reservoir could also be connected to a remote signaling device to indicate to an operator that portable pumping equipment should be taken to a particular well in order to evacuate the contents of the downhole reservoir.

In yet a further embodiment of the present invention, two downhole reservoirs may be created. At least a portion of the first of the downhole reservoirs is preferably formed within the geological zone of interest that harbours the liquid hydrocarbons and the second of the downhole reservoirs formed completely below the geological zone of interest. The two downhole reservoirs provide an increased hydrocarbon retention capability and also enhance the ability to utilize the reservoirs as settling and separation tanks. It will therefore be appreciated that the formation of two downhole reservoirs would be advantageous for geological zones of interest of a higher effluent flow rate, or where there are large amounts of particulate debris or water is present in the formation. The formation of two such reservoirs may also be desirable where the nature and stability of the underground geological formations are not conducive to the formation of one larger reservoir.

Figure 2:
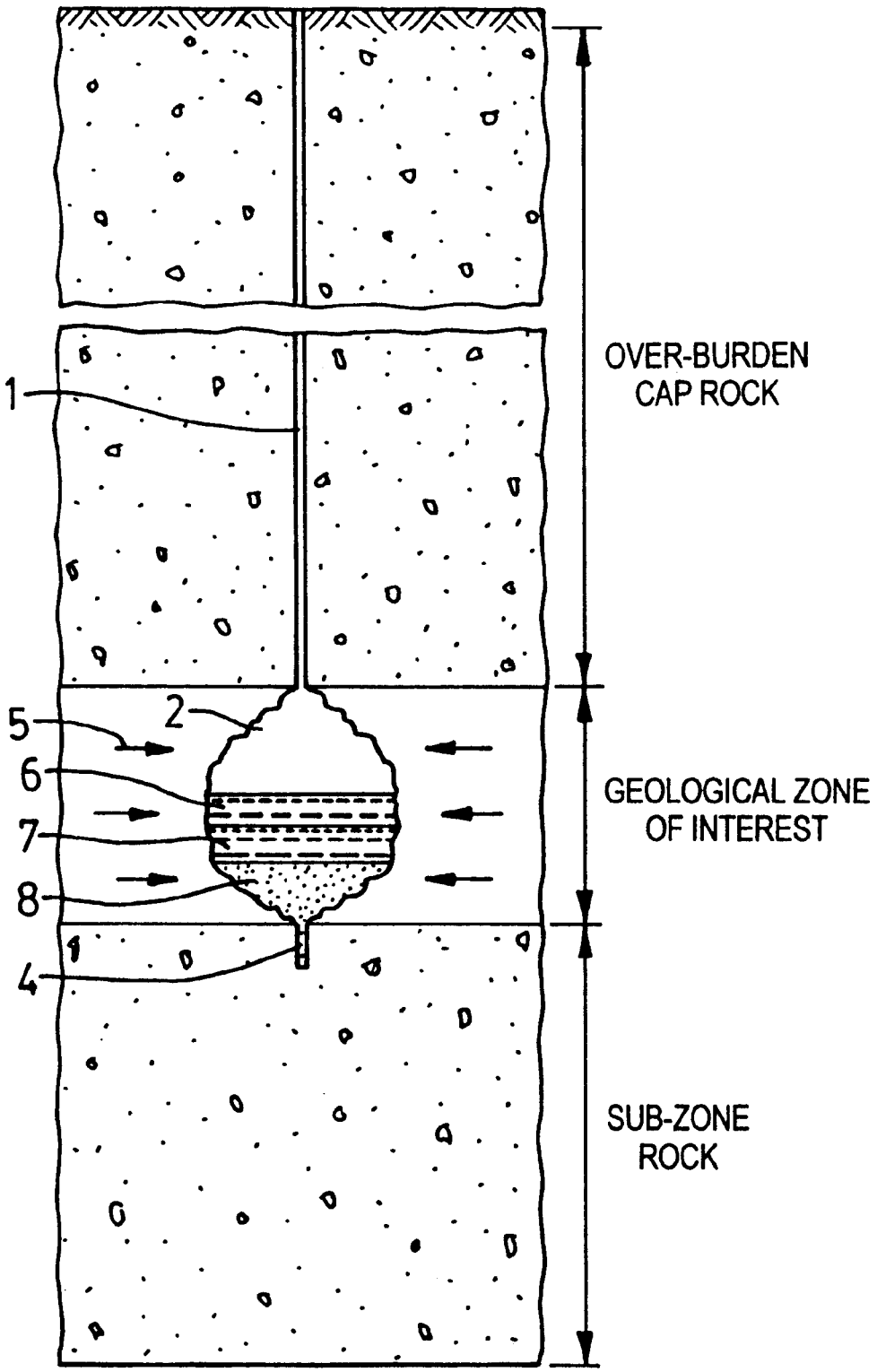
FIG. 2 is a side sectional view through a natural hydrocarbon bearing formation to which a second embodiment of the method of the present invention has been applied.
Figure 3:
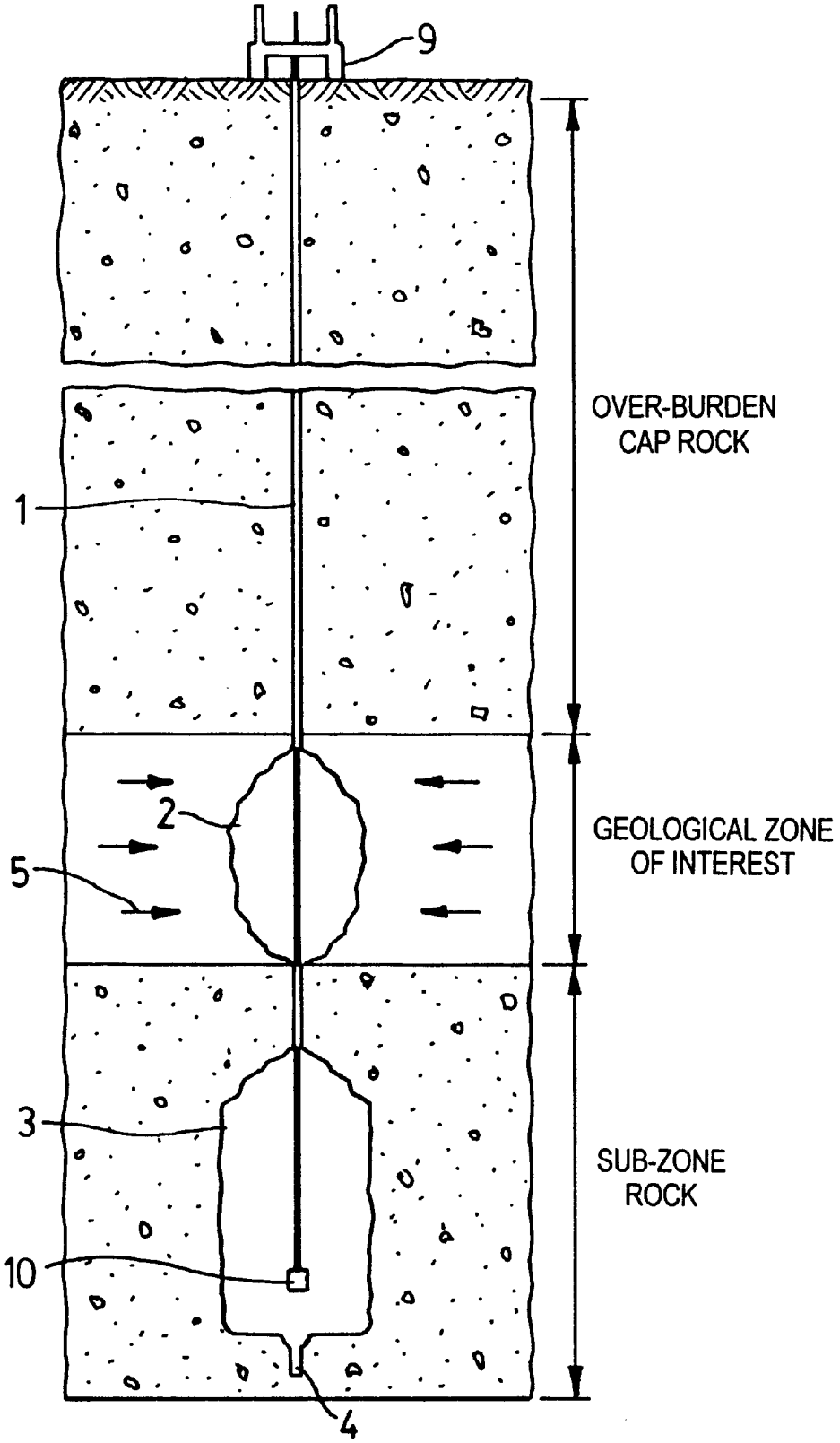
FIG. 3 is a side sectional view through a natural hydrocarbon bearing formation to which a third embodiment of the method of the present invention has been applied; and, FIG. 4 is a side sectional view through a natural hydrocarbon bearing formation to which a fourth embodiment of the method of the present invention has been applied.
Figure 4:
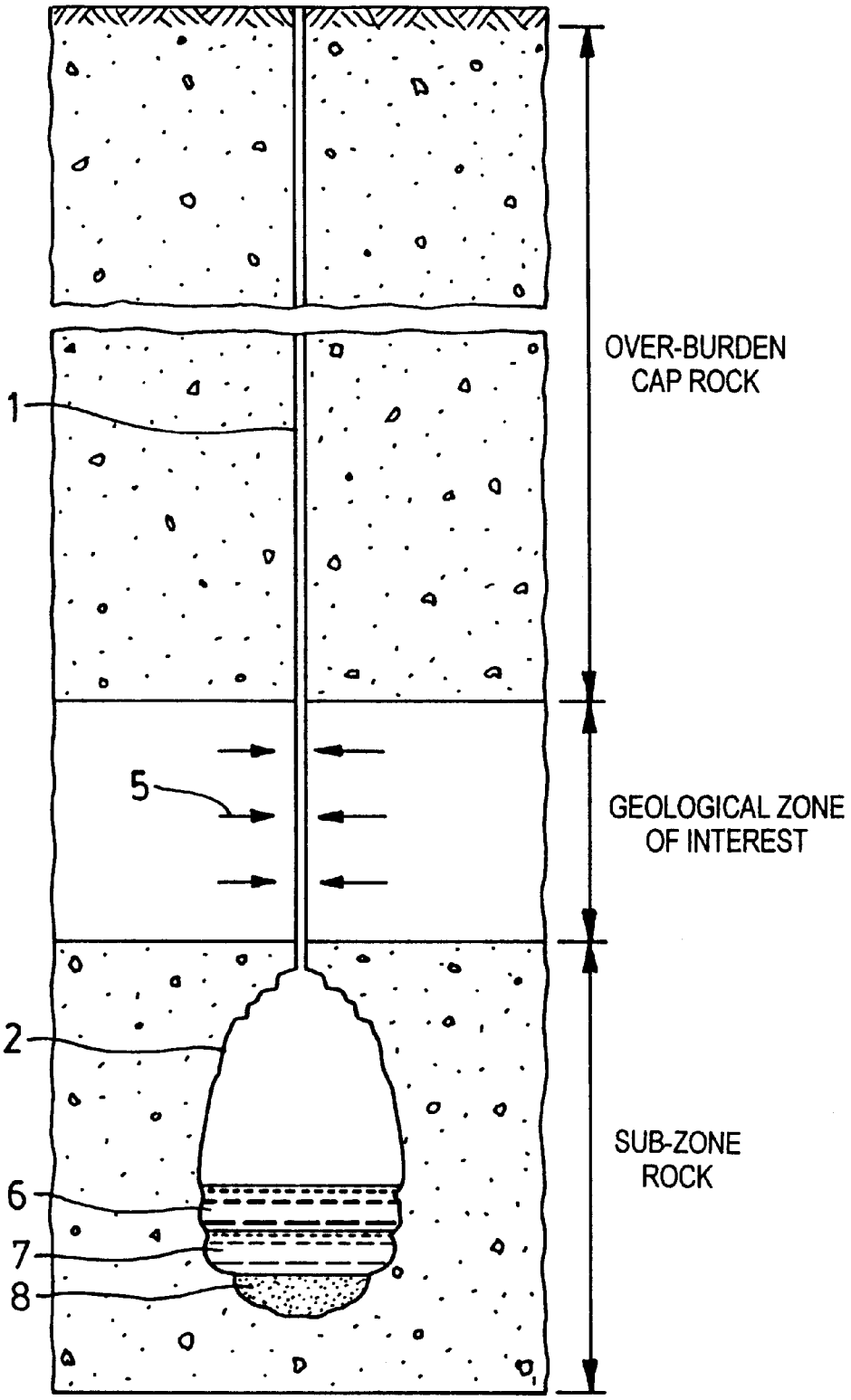

The result of the employment of the embodiments of the present invention are shown and exemplified in FIGS. 1 through 4. In each of the figures the three primary geological zones that are typically encountered when drilling an oil well are identified; namely, the overburden cap rock, the geological zone of interest or the hydrocarbon bearing zone, and the sub-zone rock. In each FIG. there is also depicted a wellbore 1 and at least one downhole reservoir 2 created through the enlargement of the wellbore. In FIG. 1 a portion of the downhole reservoir is formed within the geological zone of interest. In FIG. 2 the entire downhole reservoir is shown as being formed completely within the geological zone of interest. In FIG. 3 a pair of downhole reservoirs (2 and 3 respectively) have been created with the first or upper downhole reservoir 2 formed completely within the geological zone of interest and the second or lower downhole reservoir 3 formed completely below the geological zone of interest and in the sub-zone rock. Finally, in FIG. 4 downhole reservoir 2 is positioned completely below the geological zone of interest and within the sub-zone rock.

It will be appreciated by those skilled in the art that the precise three dimensional geometric shape of the downhole reservoir can be varied depending upon the particular tools and methods of excavation that are utilized and the inherent strength and characteristics of the rock. It will also be appreciated that where the downhole reservoir is lined, the shape of the reservoir will to a large extent depend upon the nature and configuration of the lining used. In addition, in situations where the downhole reservoir is not formed at the bottom of the wellbore, a wellbore overhole 4 may be present.

In FIGS. 1 through 4, the flow of effluent into the wellbore and the downhole reservoir from the geological zone of interest is indicated generally by arrows 5. As effluent seeps into the wellbore and the downhole reservoir the differences in the specific gravity of its constituent parts will result in a settling, separation or stratification of the various components. For example, where the effluent includes water, solid sediments, and crude oil they will tend to separate into distinctive layers within the downhole reservoir such that a layer of crude oil 6 is formed above an intermediary layer of water 7 with solid sediments 8 settling to the bottom of the reservoir. It will thus be appreciated that through the use of a mobile pumping unit 9 (see FIG. 3) a submersible pump or suction line 10 could be lowered into the wellbore so as to specifically extract a portion or all of the water, crude oil (or other hydrocarbons), or solid sediment that has accumulated within the downhole reservoir. Alternatively, there is provided a crude ability to progressively evacuate the accumulated effluent into basic components as the effluent is drawn down.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A method of extracting liquid hydrocarbons from geological formations having reduced or low liquid hydrocarbon flow rates wherein conventional extraction methods that utilize a small diameter wellbore extending downwardly from the surface of the ground into the geological zone of interest that harbours liquid hydrocarbons have been previously employed, the method comprising the steps of:

(i) calculating the approximate flow rate of effluent from the geological zone of interest;

(ii) creating at least one downhole reservoir through enlarging a lower portion of the existing small diameter wellbore, said downhole reservoir substantially larger than the existing small diameter wellbore and having a size sufficient to hold a desired amount of effluent based upon the approximated flow rate of effluent from the geological zone of interest;

(iii) lining said downhole reservoir to prevent sloughing of its sides;

(iv) allowing effluent to accumulate in said downhole reservoir for a desired length of time until effluent in said reservoir reaches a desired level; and, (v)thereafter evacuating accumulated effluent from said downhole reservoir through the use of a pump or artificial lifting means.

2. The method as claimed in claim 1 wherein at least a portion of said downhole reservoir is formed within the geological zone of interest that harbours liquid hydrocarbons.

3. The method as claimed in claim 2 including the further step of utilizing said downhole reservoir as a below ground settling and separation tank to assist in the physical separation of liquid hydrocarbons from water and particulate debris.

4. The method as claimed in claim 3 wherein said step of lining said at least one downhole reservoir further prevents an invasion of non-commercial effluents into said downhole reservoir and the escape of accumulated effluent from said downhole reservoir.

5. The method as claimed in claim 3 wherein the evacuation of accumulated effluent from said downhole reservoir is accomplished through inserting a suction line, attached to an above ground pump, downwardly through said well bore into said downhole reservoir.

6. The method as claimed in claim 3 wherein the evacuation of accumulated effluent from said downhole reservoir is accomplished through inserting a submersible pump down said wellbore and into said downhole reservoir.

7. The method as claimed in claim 1 wherein said downhole reservoir is created completely within the geological zone of interest that harbours liquid hydrocarbons.

8. The method as claimed in claim 1 wherein said downhole reservoir is formed through the use of high pressure water jets, mechanical boring equipment, microwave vibration equipment, laser destruction equipment, or explosives.

9. A method of extracting hydrocarbons from underground geological formations comprising the steps of:

(i) forming a small diameter wellbore from the surface of the ground into the earth such that the small diameter wellbore intersects the geological zone of interest that harbours liquid hydrocarbons;

(ii) calculating the approximate flow rate of effluent from the geological zone of interest, said effluent including liquid hydrocarbons;

(iii) creating at least one downhole reservoir through enlarging a portion of said small diameter wellbore, said downhole reservoir substantially larger than said wellbore and formed so as to hold a desired amount of effluent from the geological zone of interest based upon said approximated flow rate, said downhole reservoir created completely below the geological zone of interest that harbours liquid hydrocarbons;

(iv) allowing effluent to accumulate in said downhole reservoir for a desired length of time until effluent in said downhole reservoir reaches a desired level; and, (v) thereafter evacuating accumulated effluent from said downhole reservoir through the use of a pump or artificial lifting means.

10. The method as claimed in claim 9 including the further step of utilizing said downhole reservoir as a below ground settling and separation tank to assist in the physical separation of liquid hydrocarbons from water and particulate debris.

11. The method as claimed in claim 10 wherein at least a portion of said downhole reservoir is formed within the geological zone of interest that harbours liquid hydrocarbons.

12. A method of extracting liquid hydrocarbons from geological formations having reduced or low liquid hydrocarbon flow rates wherein conventional extraction methods that utilize a small diameter wellbore extending downwardly from the surface of the ground into the geological zone of interest that harbours liquid hydrocarbons have been previously employed, the method comprising the steps of:

(i) calculating the approximate flow rate of effluent from the geological zone of interest;

(ii) creating at least one downhole reservoir through enlarging a lower portion of the existing small diameter wellbore, said downhole reservoir substantially larger than the existing small diameter wellbore and having a size sufficient to hold a desired amount of effluent based upon the approximated flow rate of effluent from the geological zone of interest, said downhole reservoir created completely below the geological zone of interest that harbours liquid hydrocarbons;

(iii) allowing effluent to accumulate in said downhole reservoir for a desired length of time until effluent in said reservoir reaches a desired level; and, (iv) evacuating accumulated effluent from said downhole reservoir through the use of a pump or artificial lifting means.

13. A method of extracting liquid hydrocarbons from geological formations having reduced or low liquid hydrocarbon flow rates wherein conventional extraction methods that utilize a small diameter wellbore extending downwardly from the surface of the ground into the geological zone of interest that harbours liquid hydrocarbons have been previously employed, the method comprising the steps of:

(i) calculating the approximate flow rate of effluent from the geological zone of interest;

(ii) creating at least two downhole reservoirs through enlarging lower portions of the existing small diameter wellbore, said downhole reservoirs substantially larger than the existing small diameter wellbore and having a size sufficient to hold a desired amount of effluent based upon the approximated flow rate of effluent from the geological zone of interest, at least a portion of one of said downhole reservoirs formed within the geological zone of interest that harbours liquid hydrocarbons and at least one of said downhole reservoirs positioned completely below the geological zone of interest that harbours liquid hydrocarbons, said downhole reservoirs providing increased hydrocarbon retention capacity and enhanced settling and separation of liquid hydrocarbons from water and particulate debris;

(iii) allowing effluent to accumulate in one or more of said downhole reservoirs for a desired length of time until effluent in said reservoirs reaches a desired level; and, (iv) evacuating accumulated effluent from one or more of said downhole reservoirs through the use of a pump or artificial lifting means.

14. A method of extracting hydrocarbons from underground geological formations comprising the steps of:

(i) forming a small diameter wellbore from the surface of the ground into the earth such that the small diameter wellbore intersects the geological zone of interest that harbours liquid hydrocarbons;

(ii) calculating the approximate flow rate of effluent from the geological zone of interest, said effluent including liquid hydrocarbons;

(iii) creating at least two downhole reservoirs through enlarging portions of said small diameter wellbore such that said downhole reservoirs are substantially larger than said wellbore and are formed so as to hold a desired amount of effluent from the geological zone of interest based upon said approximated flow rate, at least a portion of one of said downhole reservoirs formed within the geological zone of interest that harbours liquid hydrocarbons and at least one of said downhole reservoirs positioned completely below the geological zone of interest that harbours liquid hydrocarbons, said downhole reservoirs providing increased hydrocarbon retention capacity and enhanced settling and separation of liquid hydrocarbons from water and particulate debris;

(iv) allowing effluent to accumulate in one or more of said downhole reservoirs for a desired length of time until effluent in said downhole reservoirs reaches a desired level; and, (v) evacuating accumulated effluent from from one or more of said downhole reservoirs through the use of a pump or artificial lifting means.

* * * * *